US005302003A

United States Patent [19]

Xenofos

[11] Patent Number: 5,302,003

[45] Date of Patent: Apr. 12, 1994

[54] COLLAPSIBLE FOOTREST

[76] Inventor: Judy Xenofos, 5212 Ua Rd., Kapaa, Kauai, Hi. 96746

[21] Appl. No.: 992,781

[22] Filed: Dec. 18, 1992

[51] Int. Cl.[5] ..... A47C 7/50

[52] U.S. Cl. ..... 297/423.44; 297/423.41; 297/DIG. 3; 5/648; 5/651

[58] Field of Search ..... 297/439, 423, DIG. 3, 297/423.1, 423.11, 423.14, 423.16, 423.39, 423.41, 423.44, 423.45; 5/652, 648, 651, 643, 644

[56] References Cited

U.S. PATENT DOCUMENTS

| | | | |
|---|---|---|---|
| D. 285,752 | 9/1986 | Sadow | 5/648 |
| 2,612,645 | 10/1952 | Boland | 297/DIG. 3 |
| 3,065,992 | 11/1962 | Nagel | 297/439 |
| 3,644,949 | 2/1972 | Diamond | 5/648 |
| 3,680,918 | 8/1972 | Briggs | 297/DIG. 3 |
| 4,916,765 | 4/1990 | Castronovo | 5/643 |
| 4,918,774 | 4/1990 | Popitz | 5/644 |
| 5,173,979 | 12/1992 | Nennhaus | 5/648 |

FOREIGN PATENT DOCUMENTS

| | | | |
|---|---|---|---|
| 0643128 | 5/1984 | Switzerland | 5/644 |
| 2052255 | 1/1981 | United Kingdom | 297/DIG. 3 |

*Primary Examiner*—Paula A. Bradley
*Assistant Examiner*—James Miner
*Attorney, Agent, or Firm*—Michael I. Kroll

[57] ABSTRACT

A collapsible footrest is provided, which consists of a base having an inflatable chamber. The base is made of flexible material with a top contoured surface to support the feet of a person and a flat bottom to sit upon the floor. A mechanism is for inflating and deflating the chamber of the base, whereby the base may be folded when deflated, so as to occupy considerably less storage space.

7 Claims, 2 Drawing Sheets

COLLAPSIBLE FOOTREST

BACKGROUND OF THE INVENTION

1. Field of the Invention

The instant invention relates generally to hassocks and more specifically it relates to a collapsible footrest.

2. Description of the Prior Art

Numerous hassocks have been provided in prior art that are thick cushions used as footstools for supporting and resting the feet of people. While these units may be suitable for the particular purpose to which they address, they would not be as suitable for the purposes of the present invention as heretofore described.

SUMMARY OF THE INVENTION

A primary object of the present invention is to provide a collapsible footrest that will overcome the shortcomings of the prior art devices.

Another object is to provide a collapsible footrest that is very lightweight so as to be portable and since it is collapsible, it can be compressed when not in use to be stored in convenient locations.

An additional object is to provide a collapsible footrest that gives comfort to the feet, can prevent the feet from swelling and contains a structure thereon to produce stimulation to the soles of the feet for increasing circulation of the blood.

A further object is to provide a collapsible footrest that is simple and easy to use.

A still further object is to provide a collapsible footrest that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

DETAILED DESCRIPTION OF THE PREFERRED EMBODIMENTS

Figure 4:
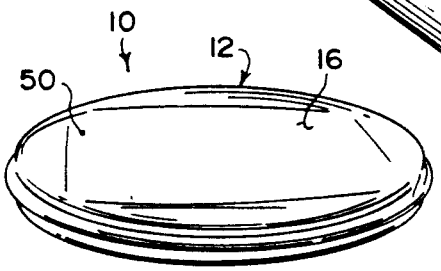
FIG. 4 is a perspective view showing the instant invention in its collapsed deflated storage position.

Turning now descriptively to the drawings, in which similar reference characters denote similar elements throughout the several views, FIGS. 1 through 4 illustrate a collapsible footrest 10 which consists of a base 12 having an inflatable chamber 14. The base 12 is made of a flexible material 16, with a top contoured surface 18 to support the feet 20 of a person 22 and a flat bottom 24 to sit upon the floor 26. A mechanism 28 is for inflating and deflating the chamber 14 of the base 12, whereby the base 12 may be folded when deflated, as shown in FIG. 4, so as to occupy considerably less storage space.

The inflating and deflating mechanism 28 contains an air valve 30 affixed to the base 12, to allow air to enter and exit the chamber 14, so that the base 12 may be inflated for use and deflated for storage as required. A plug 31 is for closing the air valve 31 after the chamber 14 is inflated.

The collapsible footrest 10 further includes a structure 32 located on the top contoured surface 18 of the base 12, for massaging the feet 20 of the person 22. The massaging structure 32 includes a plurality of protrusions 34 on a forward portion of the top contoured surface 18 of the base 12, to produce stimulation to the soles of the feet 20 for increasing circulation of blood within the feet 20.

The collapsible footrest 10 further contains an apparatus 36 on the base 12, for adjusting the height of the base 12 and allowing the base 12 to fold into itself in a deflated condition. The adjusting apparatus 36 includes a plurality of zig-zag slide fasteners 38, with each of the slide fasteners 38 having an expansion flap 40 between two rows of teeth 42. When the slide fasteners 38 are opened the expansion flaps 40 can be extended to increase the height of the base 12.

Figure 2:
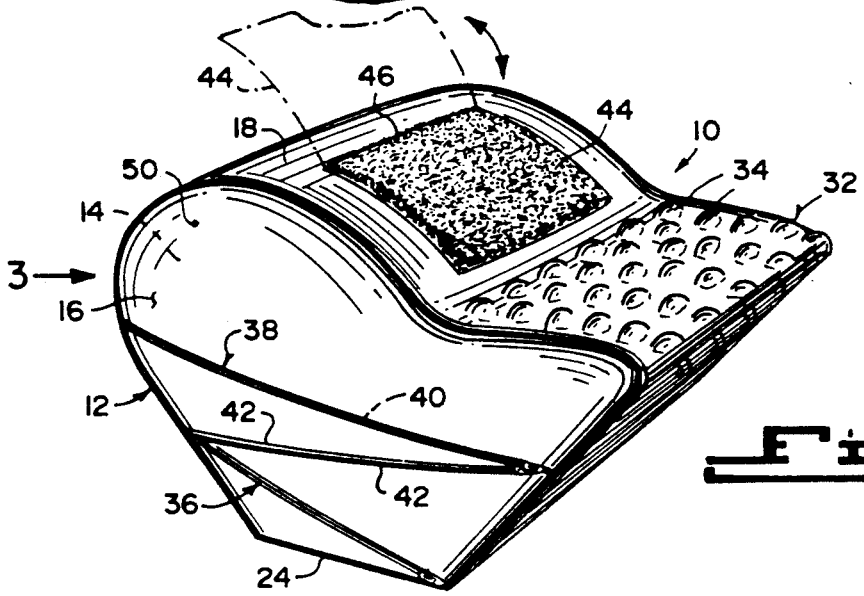
FIG. 2 is a front perspective view of the instant invention in its inflated position.
Figure 3:
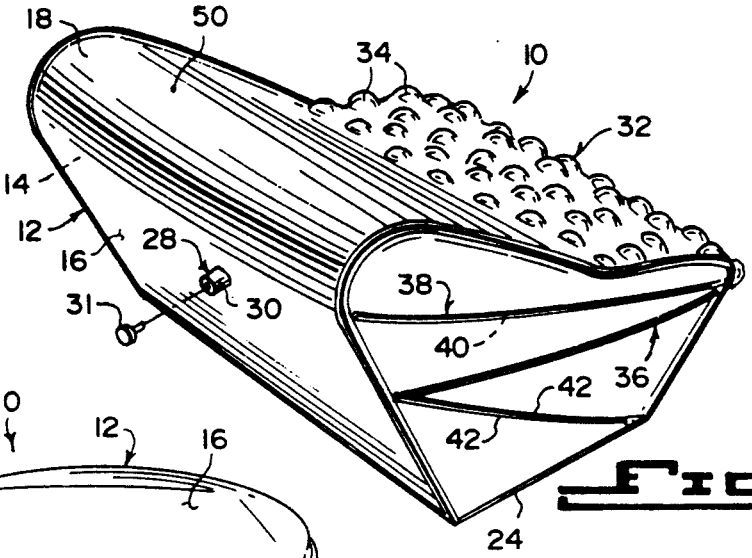
FIG. 3 is a rear perspective view of the instant invention taken in direction of arrow 3 in FIG. 2.

As shown in FIG. 2, a piece of felt carpet 44 can be secured along an upper edge 46 onto a rearward portion of the top contoured surface 18 of the base 12. When the felt carpet 44 is flipped down it will keep the feet 20 of the person 22 warm. When the felt carpet 44 is flipped up the rearward portion of the top contoured surface 18 of the base 12 will keep the feet of the person 22 cool.

Figure 5:
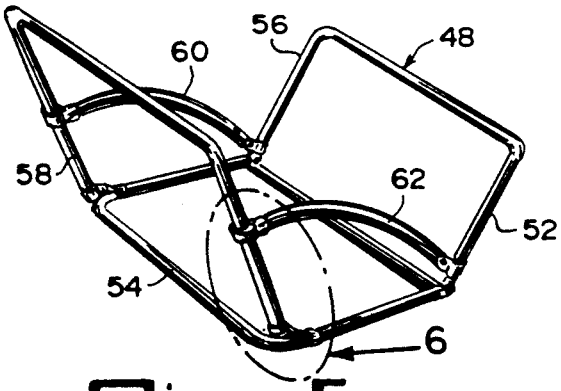
FIG. 5 is a rear perspective view of the internal frame in its extended position.
Figure 6:
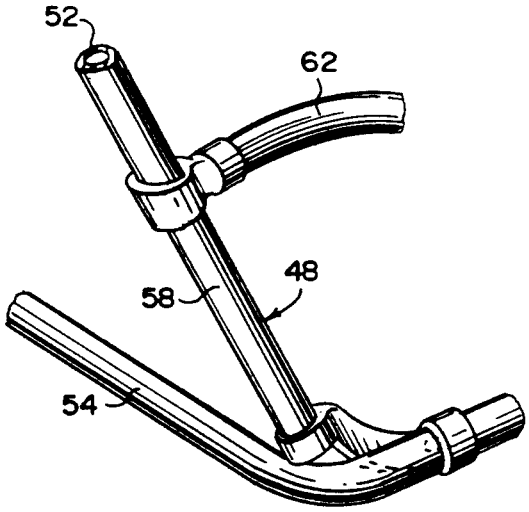
FIG. 6 is an enlarged perspective view of a portion of the internal frame as indicated by arrow 6 in FIG. 5.
Figure 7:
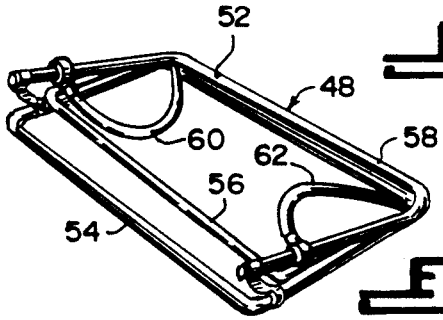
FIG. 7 is a rear perspective view of the internal frame in its collapsed position.

The collapsible footrest 10 can further include a foldable frame 48, as shown in FIGS. 5, 6 and 7, internally placed within the chamber 14 of the base 12 to strengthen the base when inflated. The flexible material 16 of the base 12 is fabricated out of a rubber latex substance 50, while the foldable frame 48 is fabricated out of a hard plastic substance 52.

The foldable frame 48 consists of three tubular segments hinged together to form a bottom portion 54, a front portion 56 and a rear portion 58 of the foldable frame 48. Two curved tubular segments are also provided with each hinged between the front portion 56 and the rear portion 58, to form opposite side portions 60 and 62 of the foldable frame 48, which will fold down when the foldable frame is collapsed as shown in FIG. 7.

Figure 1:
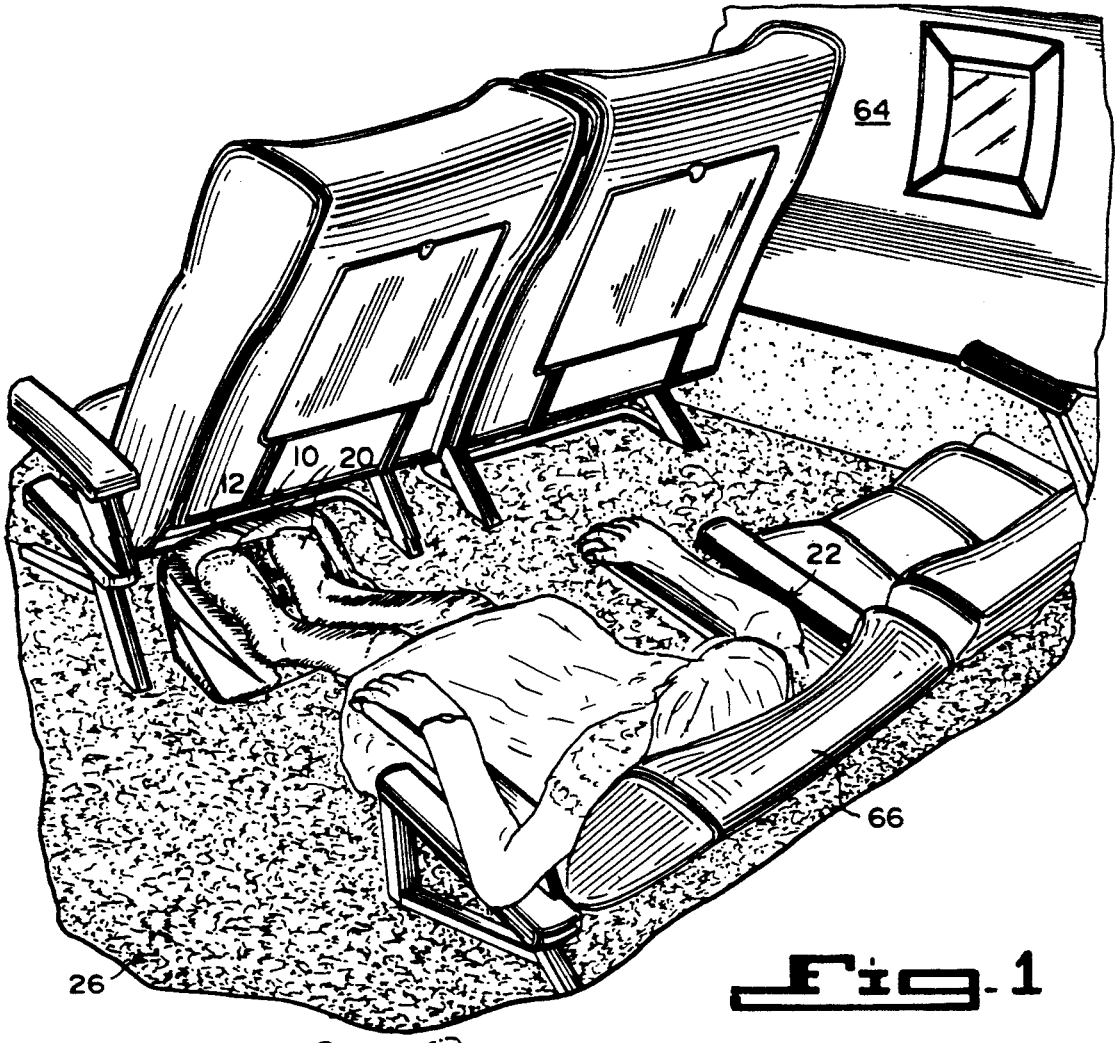
FIG. 1 is a perspective view of a portion of a passenger cabin of an aircraft showing the instant invention in use.

The collapsible footrest 10 can be utilized in a passenger cabin 64 of an aircraft as shown in FIG. 1. It can also be used by people who work at desks and wish to raise their knees to relieve pressure on the lower back. When in the collapsed position the footrest 10 can be slipped into a travel bag and placed under the seat 66 on the aircraft. When removed from the travel bag it can be inflated through the air valve 30.

The collapsible footrest 10 can be manufactured in various beautiful colors and prints like rainbows, stripes and similar configurations. It can also be personalized for travelers in matching colors and prints to their luggage sets. It could be purchased in any type of store, such as department, gift, airport shops, travel and luggage shops, as well as through catalogs and direct marketing on television.

The collapsible footrest 10 if used on aircraft, must be of a proper dimension to be able to fit behind and under a seat in front of a passenger using it and not protrude into the aisle.

To use the collapsible footrest 10 the following steps should be taken:

1. Remove the collapsed footrest 10 from the travel bag if a travel bag is provided.
2. Inflate the chamber 14 in the base 12 by forcing air through the air valve 30 after the plug 34 is removed therefrom.
3. Unfold the foldable frame 48 if supplied within the base 12.
4. Open the slide fasteners 38 if more height is needed.
5. Place the base 12 on the floor 26 behind the seat in front.
6. Sit down in your seat 66 and place your feet 20 on the top contoured surface 18 of the base 12.
7. Deflate the chamber 14 in the base 12 by releasing the air through the air valve 30, when the footrest 10 is no longer needed.
8. Fold down the foldable frame 48 within the chamber 14 in the base 12.
9. Replace the collapsed footrest 10 back into the travel bag, so it can be used again at a future time.

LIST OF REFERENCE NUMBERS

10: collapsible footrest
12: base
14: inflatable chamber in 12
16: flexible material for 12
18: top contoured surface of 12
20: feet
22: person
24: flat bottom of 12
26: floor
28: inflating and deflating mechanism on 12
30: air valve for 28
31: plug for 30
32: massaging structure on 18
34: protrusion
36: adjusting apparatus
38: slide fastener
40: expansion flap
42: row of teeth of 38
44: flat carpet
46: upper edge of 44
48: foldable frame
50: rubber latex substance for 16
52: hard plastic substance for 48
54: bottom portion of 48
56: front portion of 48
58: rear portion of 48
60: side portion of 48
62: side portion of 48

It will be understood that each of the elements described above, or two or more together may also find a useful application in other types of methods differing from the type described above.

While certain novel features of this invention have been shown and described and are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and desired to be protected by Letters Patent is set forth in the appended claims:

1. A collapsible footrest which comprises:

a) a base having an inflatable chamber, said base made of flexible material with a top contoured surface to support the feet of a person and a flat bottom to sit upon the floor;

b) means for inflating and deflating said chamber of said base, whereby said base may be folded when deflated, so as to occupy considerably less storage space, said inflating and deflating means includes an air valve affixed to said base to allow air to enter and exit said chamber, so that said base may be inflated for use and deflated for storage as required, and a plug for closing said air valve after said chamber is inflated;

c) means located on said top contoured surface of said base for massaging the feet of the person, said massaging means includes a plurality of protrusions on a forward portion of said top contoured surface of said base to produce stimulation to the soles of the feet for increasing circulation of blood within feet; and d) means on said base for adjusting the height of said base and allowing said base to fold itself in a deflated condition, said adjusting means includes a plurality of zig-zag slide fasteners, with each of said slide fasteners having an expansion flap between two rows of teeth, so that when said slide fasteners are opened said expansion flaps can be extended to increase the height of said base.

2. A collapsible footrest as recited in claim 1, further including a piece of felt carpet secured along an upper edge onto a rearward portion of said top contoured surface of said base, so that when said felt carpet is flipped down it will keep the feet of the person warm and when said felt carpet is flipped up said rearward portion of said top contoured surface of said base will keep the feet of the person cool.

3. A collapsible footrest as recited in claim 2, further including a foldable frame internally placed within said chamber of said base to strengthen said base when inflated.

4. A collapsible footrest as recited in claim 3, wherein said flexible material of said base is fabricated out of a rubber latex substance.

5. A collapsible footrest as recited in claim 4, wherein said foldable frame is fabricated out of a hard plastic substance.

6. A collapsible footrest as recited in claim 5, wherein said foldable frame includes three tubular segments hinged together to form a bottom portion, a front portion and a rear portion of said foldable frame.

7. A collapsible footrest as recited in claim 6, wherein said foldable frame further includes two curved tubular segments, each hinged between said front portion and said rear portion to form opposite side portions of said foldable frame, which will fold down when said foldable frame is collapsed.

* * * * *